United States Patent [19]

Röck et al.

[11] 4,045,097

[45] Aug. 30, 1977

[54] PULL-OUT GUIDE

[76] Inventors: Erich Röck, Kuferstrasse 1085, A-6973 Hochst, Germany; Bernhard Mages, Hartle 10, A-6850 Dornburn, Austria

[21] Appl. No.: 693,908

[22] Filed: June 8, 1976

[51] Int. Cl.[2] ..... F16C 29/02

[52] U.S. Cl. ..... 308/3.8

[58] Field of Search ..... 308/3.8, 3.6; 312/348

[56] References Cited

U.S. PATENT DOCUMENTS

| | | | |
|---|---|---|---|
| 3,801,166 | 4/1974 | York | 308/3.8 |
| 3,929,387 | 12/1975 | Grass | 308/3.8 |

*Primary Examiner*—Philip Goodman

*Assistant Examiner*—Gene A. Church

[57] ABSTRACT

A pull-out guide for drawers or the like, where the drawer has two external sides, for use in a fixed structure having two internal sides includes support rails which may be placed on each of the fixed structure sides for supporting the drawer, guide rails disposed on the external sides of the drawer, and a plurality of rollers. Each of the rollers is supported between a corresponding guide and support rail for taking up vertical forces. Each support rail has a track and each of the guide rails has a front end. An adjustment element is disposed at the front end of at least one of the guide rails and rests on the track. The adjustment element is wedge-shaped and may be positioned vertically with respect to at least one of the guide rails.

6 Claims, 5 Drawing Figures

PULL-OUT GUIDE

The invention relates to a pull-out guide for drawers or suchlike with one supporting rail on the body on either side and a pull-out rail on the drawer on either side and rollers taking the vertical forces arising on both sides between the pull-out rail and the supporting rail, which rollers are mounted in a roller-carrier in the form of a carriage.

Such pull-out guides are widely used for drawers and also for shelving and suchlike in modern furniture production and here again in kitchen furniture production in particular.

Their task is generally to facilitate extraction of the drawers and ensure this takes place with the minimum possible obstruction and in addition to make it possible to hold the drawer extracted for the most part at least in the piece of furniture.

Known drawer guides are generally fitted with rollers, but also with slides preferably in plastic or with a combustion of roller and slides, and also with freely moving balls.

The object of the invention is to make possible exact vertical alignment of the drawer and thus of the front panel of the drawer with pull-out guides of this kind. In addition slight tilting of the drawer when pushed in is to be prevented.

This is achieved in accordance with the invention through a leading element disposed preferably adjustable vertically at the front end of the guide rail, which leading element rests on the lower horizontal face of the supporting rail when the drawer is closed and the leading edge of which is wedge-shaped in the direction of insertion.

Advantageously provision is made for the leading element to be secured on a tongue bent out of the vertical face of the guide rail.

By bending the tongue the vertical position of the stop can be changed and thus tolerances can be equalised in the gaps around drawers.

A further embodiment example of the invention provides that the leading elements projects laterally over the running face of the guide rail, the leading element being made advantageously of a sythetic material, for example being injection moulded.

Such a leading element is used in cabinets where the drawer front is covered by a door or doors.

If the cabinet door is not fully opened when the drawer is pulled out, the door can easily be damaged with one of the known drawer guide systems.

Here the leading element performs two functions. It serves for the vertical adjustment of the drawer and at the same time prevents damage to the door. A separate individual door deflector is not needed.

In the following two embodiment examples of the invention are described in detail with reference to the figures in the attached drawings.

Figure 1:
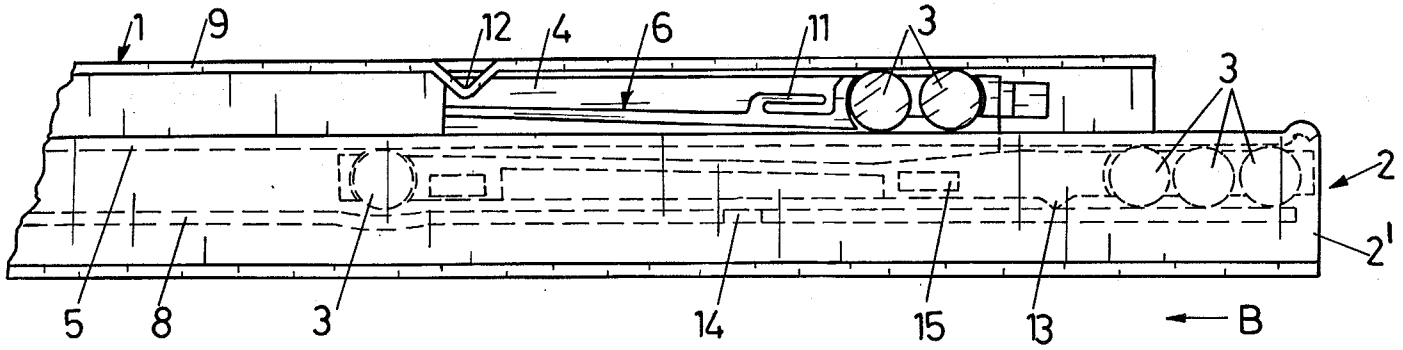
Figure 3:
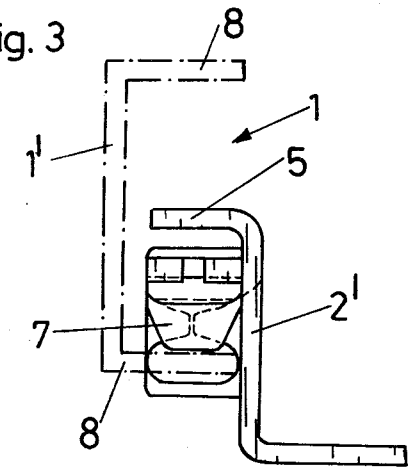
Figure 2:
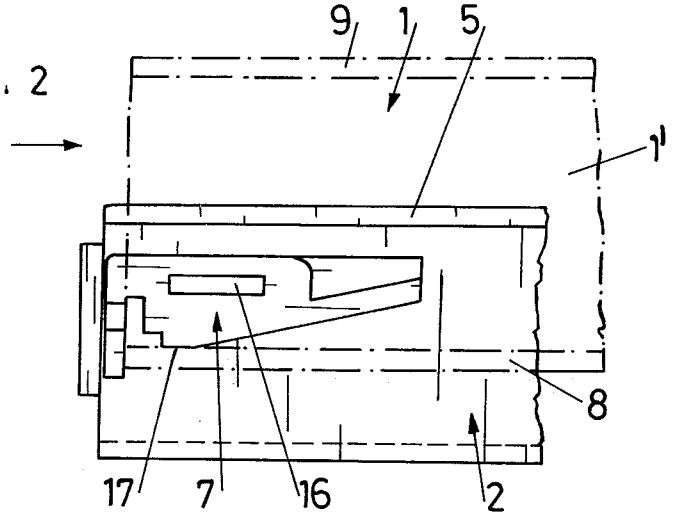
Figure 4:
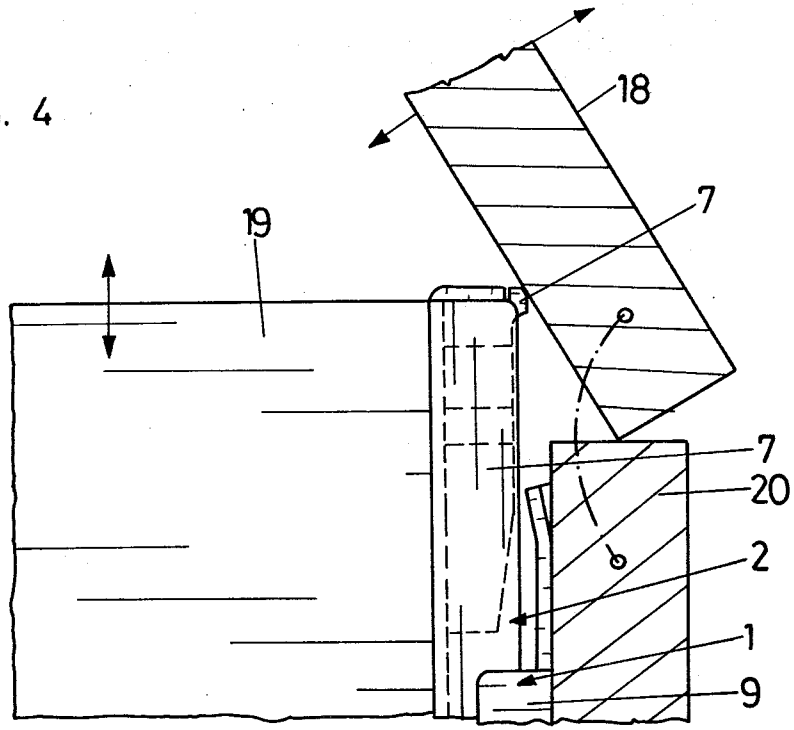
Figure 5:
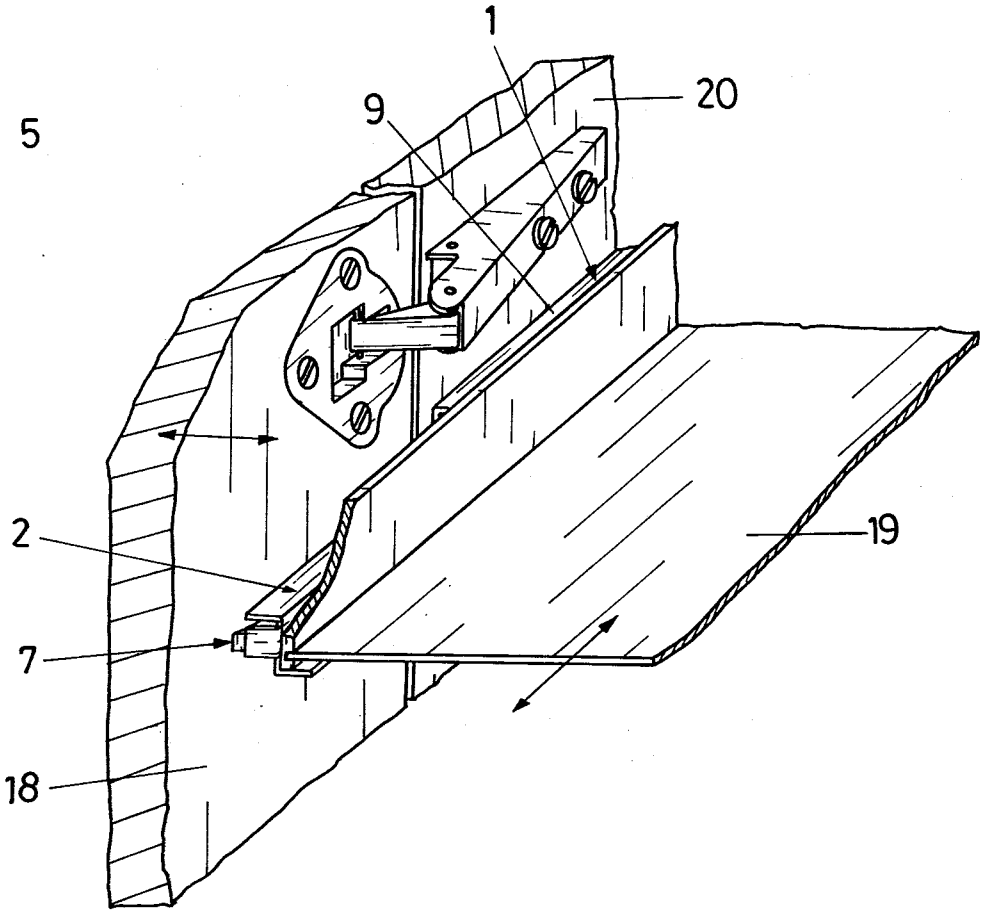

FIG. 1 shows a side view of a pull-out guide in accordance with the invention,

FIG. 2 shows a side view of the pull-out guide in accordance with the invention in the front area, FIG. 3 shows an end view in the direction of arrow A in FIG. 2, FIG. 4 shows a top view of another embodiment example of a pull-out guide in the front area and FIG. 5 shows a view of the front area of the drawer guide in accordance with the invention with parts of the door, the wall of the piece and the drawer.

The pull-out guide in accordance with the invention consists of a supporting rail 1 on the body of the piece, which rail has a U-profile for example and can be inserted into a corresponding groove in the side wall 20 of the piece of furniture or attached to the side wall 20 by means of screw, dowels or suchlike. In addition the pull-out guide comprises a guide rail 2 on the side of the drawer.

In the embodiment example shown in FIGS. 1 to 3 the guide rail 2 on the drawer side has a Z-profile so that it engages under the side wall of the drawer 19 in the assembled position.

Naturally the guide rail 2 can also be made with an L-profile.

As can be seen in the figures of the drawing, a roller carrier made in the form of a carriage 6 is disposed in the U-profile of the supporting rail 1. The carriage 6 is advantageously injection-moulded in plastic. As can be seen in FIG. 1 six rollers 3 are mounted in the carriage 6 in such a way that four rollers 3 turn on the supporting face 8 of the supporting rail 1 while two rollers 3 are located in the area of the upper horizontal face 9 of the supporting rail 1. Here the grouping of the rollers 3 depends upon the magnitude of the loading at the individual points.

With the drawer 19 pushed in the running face 5 of the guide rail 2 is inserted in the roller carrier or carriage 6 such that the running face 5 rests on the two lower roller groups while the third and (relative to the depth of the piece of furniture) middle roller group rests above on the running face 5.

Through this embodiment the guide rail 2 and with it the drawer 19 are held safe against tilting in the supporting rail 1.

If the drawer and thus the guide rail 2 are pulled out in the direction of arrow B from the piece of furniture, the freely moving carriage 6 moves with them.

In the front area the tongue 11, which is injection moulded in one piece with the carriage 6, comes to rest under a stop 12 on the supporting rail 1.

For this the stop 12 is constituted at the free edge of the upper horizontal face 9 of the supporting rail 1 and, as it does not run over the entire breadth of the horizontal face 9, simultaneously forms a lateral guide for the carriage 6 when the drawer 19 is in the extracted position, the carriage 6 being pushed with its wall 4 behind the stop 12.

The purpose of the stop 12 here is to prevent the carriage 6 from tipping over when the drawer 19 is pulled out fully.

Now if the drawer 19 is pulled out fully, the tongue 11 presses the carriage 6 downwards and with it the nose 13 forming the lock into the hole 14 in the face 8.

By virtue of this arrangement the carriage 6 remains locked in the supporting rail 1 and is prevented from falling out while the lateral guidance of the drawer 19 is missing.

In addition, to ensure particularly silent running, the embodiment example is provided with lateral compensating rollers 15 which turn about an axis normally aligned with the axis of the supporting rollers 3.

Here the aligning rollers 15 move on the vertical face 1' of the supporting rail and on the vertical face 2' of the guide rail 2. The supporting rollers 15 can be mounted for example in a manner known per se on normal axes in the carriage 6.

At the front end of the guide rail 2 a tongue 16 is provided on which is placed a leading element 7 made of plastic.

With the drawer 19 closed, the wedge-shaped leading element 7 lies with one bearing face 17 on the lower horizontal face 8 of the supporting rail 1 and thereby determines the vertical position of the front end of the guide rail 2 and thus of the drawer.

This vertical position can be modified according to whether the tongue is bent up or down. Naturally the leading element 7 can be located both on a guide rail 2 and on the two guide rails 2.

Now FIG. 4 shows an embodiment example in which the leading element 7 projects laterally over the running face 5 of the guide rail 2.

If, in such a case, the door 18 is not fully opened, the leading element 7 strikes against the door 18 and forces it open when the drawer is pulled out. Damage to the door 18, through the relatively sharp-edged running face 5 of the guide rail 2, is avoided.

In addition FIGS. 4 and 5 show the drawer 19 and the side wall 20 of the piece, together with the door 18, schematically.

We claim:

1. A pull-out for external sides, for use in a fixed structure having two internal sides comprising:

support rail means placeable on each of the fixed structure sides for supporting the drawer;

guide rail means disposed on the external sides of the drawer;

a plurality of rollers, each of said rollers being supported between a corresponding one of said guide and support rail means for taking up vertical forces, each of said support rail means having a track, said guide rail means having a front end, an adjustment element disposed at the front end of at least one of said guide rail means and resting on said track, said adjustment element being wedge-shaped and vertically positionable with respect to said at least one of said guide rail means.

2. A pull-out guide according to claim 1 further comprising roller carrier means for cooperating with said support rail means, said roller carrier means including said plurality of rollers.

3. A pull-out guide according to claim 1, wherein said at least one of the guide rail means includes a tongue projecting from said one of the guide rail means and being selectively bendable in upper and lower directions, said adjustment element being attached to said tongue, the vertical position of said tongue determining the height of the drawer above said support rail means.

4. A pull-out guide according to claim 3 wherein said adjustment element projects laterally over said track.

5. A pull-out guide according to claim 4, further comprising a door hingeably attached to said structure, said adjustment element being positionable with respect to said door so as to open the latter upon the drawer being pulled out.

6. A pull-out guide according to claim 3 wherein said adjustment element is made of synthetic plastic material.

* * * * *